US009246210B2

(12) United States Patent
Korva

(10) Patent No.: US 9,246,210 B2
(45) Date of Patent: Jan. 26, 2016

(54) ANTENNA WITH COVER RADIATOR AND METHODS

(75) Inventor: Heikki Korva, Tupos (FI)

(73) Assignee: PULSE FINLAND OY, Kempele (FI)

( * ) Notice: Subject to any disclaimer, the term of this patent is extended or adjusted under 35 U.S.C. 154(b) by 693 days.

(21) Appl. No.: 13/579,559

(22) PCT Filed: Feb. 7, 2011

(86) PCT No.: PCT/FI2011/050102

§ 371 (c)(1),
(2), (4) Date: Jan. 11, 2013

(87) PCT Pub. No.: WO2011/101534

PCT Pub. Date: Aug. 25, 2011

(65) Prior Publication Data

US 2013/0127674 A1 May 23, 2013

(30) Foreign Application Priority Data

Feb. 18, 2010 (FI) ..... 20105158

(51) Int. Cl.

| | |
|---|---|
| ***H01Q 1/24*** | (2006.01) |
| ***H01Q 1/42*** | (2006.01) |
| ***H01Q 9/04*** | (2006.01) |
| ***H01Q 9/42*** | (2006.01) |

(Continued)

(52) U.S. Cl.

CPC ..... *H01Q 1/241* (2013.01); *H01Q 1/243* (2013.01); *H01Q 1/42* (2013.01); *H01Q 5/357* (2015.01); *H01Q 5/378* (2015.01); *H01Q 9/0421* (2013.01); *H01Q 9/42* (2013.01)

(58) Field of Classification Search

CPC ..... H01Q 1/24; H01Q 1/243

USPC ..... 343/702, 767, 872

See application file for complete search history.

(56) References Cited

U.S. PATENT DOCUMENTS

| | | | |
|---|---|---|---|
| 2,745,102 | A | 5/1956 | Norgorden |
| 3,938,161 | A | 2/1976 | Sanford |

(Continued)

FOREIGN PATENT DOCUMENTS

| | | |
|---|---|---|
| CN | 1316797 | 10/2007 |
| DE | 10104862 | 8/2002 |

(Continued)

OTHER PUBLICATIONS

"An Adaptive Microstrip Patch Antenna for Use in Portable Transceivers", Rostbakken et al., Vehicular Technology Conference, 1996, Mobile Technology for the Human Race, pp. 339-343.

(Continued)

*Primary Examiner* — Dieu H Duong

(74) *Attorney, Agent, or Firm* — Gazdzinski & Associates, PC

(57) ABSTRACT

A monopole antenna applicable especially to small mobile stations. In one embodiment, the radiator of the antenna is trough-like in shape so that it covers the head surface, front and rear surfaces and both side surfaces of the dielectric cover of the radio device at an end of the device. On the side of the side surfaces slots are formed in the radiator, starting from its edge, for increasing the electric size. The radiator is fed electromagnetically by a separate element which is shaped so that the antenna has at least two operating bands. The ground plane of the antenna is in one embodiment disposed apart from the radiator, thus not extending inside the 'trough'.

21 Claims, 3 Drawing Sheets

Figure 1:
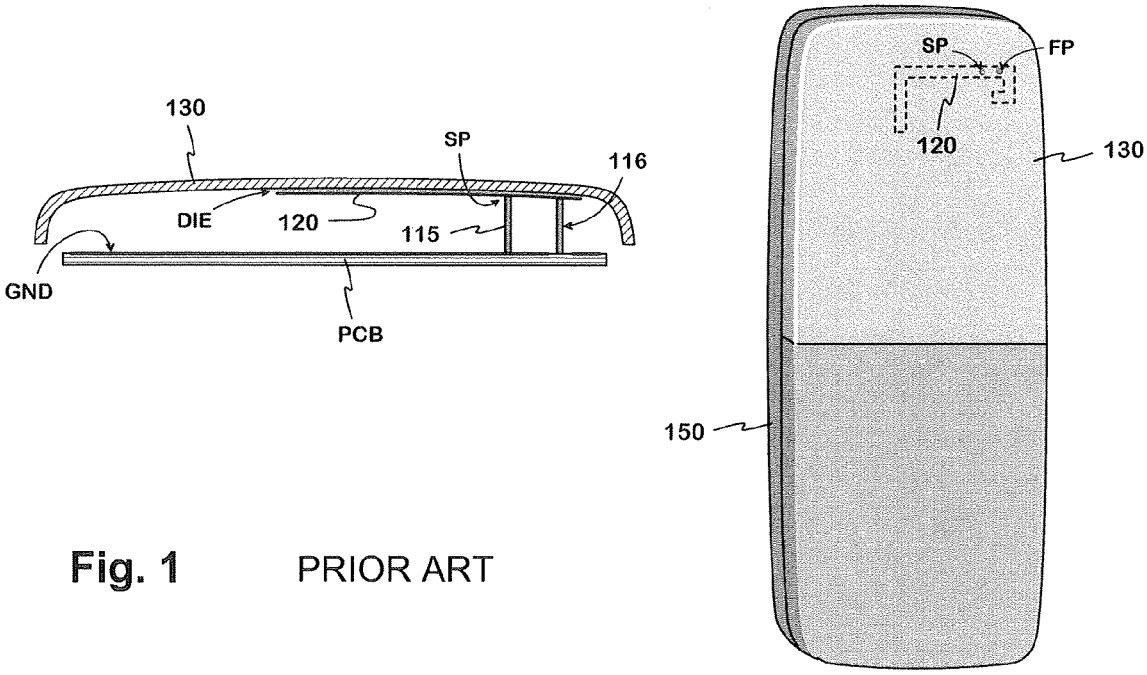
Fig. 1 PRIOR ART

(51) Int. Cl.
*H01Q 5/357* (2015.01)
*H01Q 5/378* (2015.01)

(56) References Cited

U.S. PATENT DOCUMENTS 4,004,228 A 1/1977 Mullett
4,028,652 A 6/1977 Wakino et al.
4,031,468 A 6/1977 Ziebell et al.
4,054,874 A 10/1977 Oltman
4,069,483 A 1/1978 Kaloi
4,123,756 A 10/1978 Nagata et al.
4,123,758 A 10/1978 Shibano et al.
4,131,893 A 12/1978 Munson et al.
4,201,960 A 5/1980 Skutta et al.
4,255,729 A 3/1981 Fukasawa et al.
4,313,121 A 1/1982 Campbell et al.
4,356,492 A 10/1982 Kaloi
4,370,657 A 1/1983 Kaloi
4,423,396 A 12/1983 Makimoto et al.
4,431,977 A 2/1984 Sokola et al.
4,546,357 A 10/1985 Laughon et al.
4,559,508 A 12/1985 Nishikawa et al.
4,625,212 A 11/1986 Oda et al.
4,652,889 A 3/1987 Bizouard et al.
4,661,992 A 4/1987 Garay et al.
4,692,726 A 9/1987 Green et al.
4,703,291 A 10/1987 Nishikawa et al.
4,706,050 A 11/1987 Andrews
4,716,391 A 12/1987 Moutrie et al.
4,740,765 A 4/1988 Ishikawa et al.
4,742,562 A 5/1988 Kommrusch
4,761,624 A 8/1988 Igarashi et al.
4,800,348 A 1/1989 Rosar et al.
4,800,392 A 1/1989 Garay et al.
4,821,006 A 4/1989 Ishikawa et al.
4,823,098 A 4/1989 DeMuro et al.
4,827,266 A 5/1989 Sato et al.
4,829,274 A 5/1989 Green et al.
4,835,538 A 5/1989 McKenna et al.
4,835,541 A 5/1989 Johnson et al.
4,862,181 A 8/1989 PonceDeLeon et al.
4,879,533 A 11/1989 De Muro et al.
4,896,124 A 1/1990 Schwent
4,907,006 A 3/1990 Nishikawa et al.
4,954,796 A 9/1990 Green et al.
4,965,537 A 10/1990 Kommrusch
4,977,383 A 12/1990 Niiranen
4,980,694 A 12/1990 Hines
5,016,020 A 5/1991 Simpson
5,017,932 A 5/1991 Ushiyama et al.
5,043,738 A 8/1991 Shapiro et al.
5,047,739 A 9/1991 Kuokkanene
5,053,786 A 10/1991 Silverman et al.
5,057,847 A 10/1991 Vaeisaenen
5,061,939 A 10/1991 Nakase
5,097,236 A 3/1992 Wakino et al.
5,103,197 A 4/1992 Turunen
5,109,536 A 4/1992 Kommrusch
5,155,493 A 10/1992 Thursby et al.
5,157,363 A 10/1992 Puurunen
5,159,303 A 10/1992 Flink
5,166,697 A 11/1992 Viladevall et al.
5,170,173 A 12/1992 Krenz et al.
5,203,021 A 4/1993 Repplinger et al.
5,210,510 A 5/1993 Karsikas
5,210,542 A 5/1993 Pett et al.
5,220,335 A 6/1993 Huang
5,229,777 A 7/1993 Doyle
5,239,279 A 8/1993 Turunen
5,278,528 A 1/1994 Turunen
5,281,326 A 1/1994 Galla
5,298,873 A 3/1994 Ala-Kojola
5,302,924 A 4/1994 Jantunen
5,304,968 A 4/1994 Ohtonen
5,307,036 A 4/1994 Turunen
5,319,328 A 6/1994 Turunen
5,349,315 A 9/1994 Ala-Kojola
5,349,700 A 9/1994 Parker
5,351,023 A 9/1994 Niiranen
5,354,463 A 10/1994 Turunen
5,355,142 A 10/1994 Marshall et al.
5,357,262 A 10/1994 Blaese
5,363,114 A 11/1994 Shoemaker
5,369,782 A 11/1994 Kawano et al.
5,382,959 A 1/1995 Pett et al.
5,386,214 A 1/1995 Sugawara
5,387,886 A 2/1995 Takalo
5,394,162 A 2/1995 Korovesis et al.
RE34,898 E 4/1995 Turunen
5,408,206 A 4/1995 Turunen
5,418,508 A 5/1995 Puurunen
5,432,489 A 7/1995 Yrjola
5,438,697 A 8/1995 Fowler et al.
5,440,315 A 8/1995 Wright et al.
5,442,366 A 8/1995 Sanford
5,444,453 A 8/1995 Lalezari
5,455,594 A 10/1995 Johnson
5,467,065 A 11/1995 Turunen
5,473,295 A 12/1995 Turunen
5,506,554 A 4/1996 Ala-Kojola
5,508,668 A 4/1996 Prokkola
5,510,802 A 4/1996 Tsuru et al.
5,517,683 A 5/1996 Collett et al.
5,521,561 A 5/1996 Yrjola
5,526,003 A 6/1996 Ogawa et al.
5,532,703 A 7/1996 Stephens et al.
5,541,560 A 7/1996 Turunen
5,541,617 A 7/1996 Connolly et al.
5,543,764 A 8/1996 Turunen
5,550,519 A 8/1996 Korpela
5,557,287 A 9/1996 Pottala et al.
5,557,292 A 9/1996 Nygren et al.
5,566,441 A 10/1996 Marsh et al.
5,570,071 A 10/1996 Ervasti
5,585,771 A 12/1996 Ervasti
5,585,810 A 12/1996 Tsuru et al.
5,589,844 A 12/1996 Belcher et al.
5,594,395 A 1/1997 Niiranen
5,604,471 A 2/1997 Rattila
5,627,502 A 5/1997 Ervasti
5,649,316 A 7/1997 Prodhomme et al.
5,668,561 A 9/1997 Perrotta et al.
5,675,301 A 10/1997 Nappa
5,689,221 A 11/1997 Niiranen
5,694,135 A 12/1997 Dikun et al.
5,696,517 A 12/1997 Kawahata et al.
5,703,600 A 12/1997 Burrell et al.
5,709,832 A 1/1998 Hayes et al.
5,711,014 A 1/1998 Crowley et al.
5,717,368 A 2/1998 Niiranen
5,731,749 A 3/1998 Yrjola
5,734,305 A 3/1998 Ervasti
5,734,350 A 3/1998 Deming et al.
5,734,351 A 3/1998 Ojantakanen
5,739,735 A 4/1998 Pyykko
5,742,259 A 4/1998 Annamaa
5,757,327 A 5/1998 Yajima et al.
5,760,746 A 6/1998 Kawahata
5,764,190 A 6/1998 Murch et al.
5,767,809 A 6/1998 Chuang et al.
5,768,217 A 6/1998 Sonoda et al.
5,777,581 A 7/1998 Lilly et al.
5,777,585 A 7/1998 Tsuda et al.
5,793,269 A 8/1998 Ervasti
5,797,084 A 8/1998 Tsuru et al.
5,812,094 A 9/1998 Maldonado
5,815,048 A 9/1998 Ala-Kojola
5,822,705 A 10/1998 Lehtola
5,852,421 A 12/1998 Maldonado
5,861,854 A 1/1999 Kawahata et al.
5,874,926 A 2/1999 Tsuru et al.
5,880,697 A 3/1999 McCarrick et al.
5,886,668 A 3/1999 Pedersen et al.
5,892,490 A 4/1999 Asakura et al.

(56) References Cited

U.S. PATENT DOCUMENTS 5,903,820 A 5/1999 Hagstrom
5,905,475 A 5/1999 Annamaa
5,920,290 A 7/1999 McDonough et al.
5,926,139 A 7/1999 Korisch
5,929,813 A 7/1999 Eggleston
5,936,583 A 8/1999 Maeda et al.
5,943,016 A 8/1999 Snyder, Jr. et al.
5,952,975 A 9/1999 Pedersen et al.
5,959,583 A 9/1999 Funk
5,963,180 A 10/1999 Leisten
5,966,097 A 10/1999 Fukasawa et al.
5,970,393 A 10/1999 Khorrami et al.
5,977,710 A 11/1999 Kuramoto et al.
5,986,606 A 11/1999 Kossiavas et al.
5,986,608 A 11/1999 Korisch et al.
5,990,848 A 11/1999 Annamaa
5,999,132 A 12/1999 Kitchener et al.
6,005,529 A 12/1999 Hutchinson
6,006,419 A 12/1999 Vandendolder et al.
6,008,764 A 12/1999 Ollikainen
6,009,311 A 12/1999 Killion et al.
6,014,106 A 1/2000 Annamaa
6,016,130 A 1/2000 Annamaa
6,023,608 A 2/2000 Yrjola
6,031,496 A 2/2000 Kuittinen et al.
6,034,637 A 3/2000 McCoy et al.
6,037,848 A 3/2000 Alila et al.
6,043,780 A 3/2000 Funk et al.
6,052,096 A 4/2000 Tsuru et al.
6,072,434 A 6/2000 Papatheodorou
6,078,231 A 6/2000 Pelkonen
6,091,363 A 7/2000 Komatsu et al.
6,091,365 A 7/2000 Derneryd et al.
6,097,345 A 8/2000 Walton
6,100,849 A 8/2000 Tsubaki et al.
6,112,106 A 8/2000 Crowley et al.
6,121,931 A 9/2000 Levi et al.
6,133,879 A 10/2000 Grangeat et al.
6,134,421 A 10/2000 Lee et al.
6,140,966 A 10/2000 Pankinaho
6,140,973 A 10/2000 Annamaa
6,147,650 A 11/2000 Kawahata et al.
6,157,819 A 12/2000 Vuokko
6,177,908 B1 1/2001 Kawahata
6,185,434 B1 2/2001 Hagstrom
6,190,942 B1 2/2001 Wilm et al.
6,195,049 B1 2/2001 Kim et al.
6,204,826 B1 3/2001 Rutkowski et al.
6,215,376 B1 4/2001 Hagstrom
6,218,989 B1 4/2001 Schneider et al.
6,246,368 B1 6/2001 Deming et al.
6,252,552 B1 6/2001 Tarvas et al.
6,252,554 B1 6/2001 Isohatala
6,255,994 B1 7/2001 Saito
6,268,831 B1 7/2001 Sanford
6,281,848 B1 8/2001 Nagumo et al.
6,295,029 B1 9/2001 Chen et al.
6,297,776 B1 10/2001 Pankinaho
6,304,220 B1 10/2001 Herve et al.
6,308,720 B1 10/2001 Modi
6,316,975 B1 11/2001 O'Toole et al.
6,323,811 B1 11/2001 Tsubaki
6,326,921 B1 12/2001 Egorov et al.
6,337,663 B1 1/2002 Chi-Minh
6,340,954 B1 1/2002 Annamaa et al.
6,342,859 B1 1/2002 Kurz et al.
6,343,208 B1 1/2002 Ying
6,346,914 B1 2/2002 Annamaa
6,348,892 B1 2/2002 Annamaa
6,353,443 B1 3/2002 Ying
6,366,243 B1 4/2002 Isohatala
6,377,827 B1 4/2002 Rydbeck
6,380,905 B1 4/2002 Annamaa
6,396,444 B1 5/2002 Goward
6,404,394 B1 6/2002 Hill
6,417,813 B1 7/2002 Durham et al.
6,421,014 B1 7/2002 Sanad
6,423,915 B1 7/2002 Winter
6,429,818 B1 8/2002 Johnson et al.
6,452,551 B1 9/2002 Chen
6,452,558 B1 9/2002 Saitou et al.
6,456,249 B1 9/2002 Johnson et al.
6,459,413 B1 10/2002 Tseng et al.
6,462,716 B1 10/2002 Kushihi
6,469,673 B2 10/2002 Kaiponen
6,473,056 B2 10/2002 Annamaa
6,476,767 B2 11/2002 Aoyama et al.
6,476,769 B1 11/2002 Lehtola
6,480,155 B1 11/2002 Eggleston
6,483,462 B2 11/2002 Weinberger
6,498,586 B2 12/2002 Pankinaho
6,501,425 B1 12/2002 Nagumo
6,515,625 B1 2/2003 Johnson
6,518,925 B1 2/2003 Annamaa
6,529,168 B2 3/2003 Mikkola
6,529,749 B1 3/2003 Hayes et al.
6,535,170 B2 3/2003 Sawamura et al.
6,538,604 B1 3/2003 Isohatala
6,538,607 B2 3/2003 Barna
6,542,050 B1 4/2003 Arai et al.
6,549,167 B1 4/2003 Yoon
6,552,686 B2 4/2003 Ollikainen et al.
6,556,812 B1 4/2003 Pennanen et al.
6,566,944 B1 5/2003 Pehlke
6,580,396 B2 6/2003 Lin
6,580,397 B2 6/2003 Lindell
6,600,449 B2 7/2003 Onaka et al.
6,603,430 B1 8/2003 Hill et al.
6,606,016 B2 8/2003 Takamine et al.
6,611,235 B2 8/2003 Barna et al.
6,614,400 B2 9/2003 Egorov
6,614,401 B2 9/2003 Onaka et al.
6,614,405 B1 9/2003 Mikkoken
6,634,564 B2 10/2003 Kuramochi
6,636,181 B2 10/2003 Asano
6,639,564 B2 10/2003 Johnson
6,646,606 B2 11/2003 Mikkola
6,650,295 B2 11/2003 Ollikainen et al.
6,657,593 B2 12/2003 Nagumo et al.
6,657,595 B1 12/2003 Phillips et al.
6,670,926 B2 12/2003 Miyasaka
6,677,903 B2 1/2004 Wang
6,680,705 B2 1/2004 Tan et al.
6,683,573 B2 1/2004 Park
6,693,594 B2 2/2004 Pankinaho et al.
6,717,551 B1 4/2004 Desclos et al.
6,727,857 B2 4/2004 Mikkola
6,734,825 B1 5/2004 Guo et al.
6,734,826 B1 5/2004 Dai et al.
6,738,022 B2 5/2004 Klaavo et al.
6,741,214 B1 5/2004 Kadambi et al.
6,753,813 B2 6/2004 Kushihi
6,759,989 B2 7/2004 Tarvas et al.
6,765,536 B2 7/2004 Phillips et al.
6,774,853 B2 8/2004 Wong et al.
6,781,545 B2 8/2004 Sung
6,801,166 B2 10/2004 Mikkola
6,801,169 B1 10/2004 Chang et al.
6,806,835 B2 10/2004 Iwai
6,819,287 B2 11/2004 Sullivan et al.
6,819,293 B2 11/2004 De Graauw
6,825,818 B2 11/2004 Toncich
6,836,249 B2 12/2004 Kenoun et al.
6,847,329 B2 1/2005 Ikegaya et al.
6,856,293 B2 2/2005 Bordi
6,862,437 B1 3/2005 McNamara
6,862,441 B2 3/2005 Ella
6,873,291 B2 3/2005 Aoyama
6,876,329 B2 4/2005 Milosavljevic
6,882,317 B2 4/2005 Koskiniemi
6,891,507 B2 5/2005 Kushihi et al.
6,897,810 B2 5/2005 Dai et al.
6,900,768 B2 5/2005 Iguchi et al.
6,903,692 B2 6/2005 Kivekas

(56) References Cited

U.S. PATENT DOCUMENTS 6,911,945 B2 6/2005 Korva
6,922,171 B2 7/2005 Annamaa
6,925,689 B2 8/2005 Folkmar
6,927,729 B2 8/2005 Legay
6,937,196 B2 8/2005 Korva
6,950,065 B2 9/2005 Ying et al.
6,950,066 B2 9/2005 Hendler et al.
6,950,068 B2 9/2005 Bordi
6,950,072 B2 9/2005 Miyata et al.
6,952,144 B2 10/2005 Javor
6,952,187 B2 10/2005 Annamaa
6,958,730 B2 10/2005 Nagumo et al.
6,961,544 B1 11/2005 Hagstrom
6,963,308 B2 11/2005 Korva
6,963,310 B2 11/2005 Horita et al.
6,967,618 B2 11/2005 Ojantakanen
6,975,278 B2 12/2005 Song et al.
6,980,158 B2 12/2005 Iguchi et al.
6,985,108 B2 1/2006 Mikkola
6,992,543 B2 1/2006 Luetzelschwab et al.
6,995,710 B2 2/2006 Sugimoto et al.
7,023,341 B2 4/2006 Stilp
7,031,744 B2 4/2006 Kojima et al.
7,034,752 B2 4/2006 Sekiguchi et al.
7,042,403 B2 5/2006 Colburn et al.
7,053,841 B2 5/2006 Ponce De Leon et al.
7,054,671 B2 5/2006 Kaiponen et al.
7,057,560 B2 6/2006 Erkocevic
7,061,430 B2 6/2006 Zheng et al.
7,081,857 B2 7/2006 Kinnunen et al.
7,084,831 B2 8/2006 Takagi et al.
7,099,690 B2 8/2006 Milosavljevic
7,113,133 B2 9/2006 Chen et al.
7,119,749 B2 10/2006 Miyata et al.
7,126,546 B2 10/2006 Annamaa
7,129,893 B2 10/2006 Otaka et al.
7,136,019 B2 11/2006 Mikkola
7,136,020 B2 11/2006 Yamaki
7,142,824 B2 11/2006 Kojima et al.
7,148,847 B2 12/2006 Yuanzhu
7,148,849 B2 12/2006 Lin
7,148,851 B2 12/2006 Takaki et al.
7,170,464 B2 1/2007 Tang et al.
7,176,838 B1 2/2007 Kinezos
7,180,455 B2 2/2007 Oh et al.
7,193,574 B2 3/2007 Chiang et al.
7,205,942 B2 4/2007 Wang et al.
7,215,283 B2 5/2007 Boyle
7,218,280 B2 5/2007 Annamaa
7,218,282 B2 5/2007 Humpfer et al.
7,224,313 B2 5/2007 McKinzie, III et al.
7,230,574 B2 6/2007 Johnson
7,233,775 B2 6/2007 De Graauw
7,237,318 B2 7/2007 Annamaa
7,256,743 B2 8/2007 Korva
7,274,334 B2 9/2007 O'Riordan et al.
7,283,097 B2 10/2007 Wen et al.
7,289,064 B2 10/2007 Cheng
7,292,200 B2 11/2007 Posluszny et al.
7,319,432 B2 1/2008 Andersson
7,330,153 B2 2/2008 Rentz
7,333,067 B2 2/2008 Hung et al.
7,339,528 B2 3/2008 Wang et al.
7,340,286 B2 3/2008 Korva et al.
7,345,634 B2 3/2008 Ozkar et al.
7,352,326 B2 4/2008 Korva
7,355,270 B2 4/2008 Hasebe et al.
7,358,902 B2 4/2008 Erkocevic
7,375,695 B2 5/2008 Ishizuka et al.
7,381,774 B2 6/2008 Bish et al.
7,382,319 B2 6/2008 Kawahata et al.
7,385,556 B2 6/2008 Chung et al.
7,388,543 B2 6/2008 Vance
7,391,378 B2 6/2008 Mikkola
7,405,702 B2 7/2008 Annamaa et al.
7,417,588 B2 8/2008 Castany et al.
7,423,592 B2 9/2008 Pros et al.
7,432,860 B2 10/2008 Huynh
7,439,929 B2 10/2008 Ozkar
7,443,344 B2 10/2008 Boyle
7,468,700 B2 12/2008 Milosavljevic
7,468,709 B2 12/2008 Niemi
7,498,990 B2 3/2009 Park et al.
7,501,983 B2 3/2009 Mikkola
7,502,598 B2 3/2009 Kronberger
7,564,413 B2 7/2009 Kim et al.
7,589,678 B2 9/2009 Perunka et al.
7,616,158 B2 11/2009 Mark et al.
7,633,449 B2 12/2009 Oh
7,663,551 B2 2/2010 Nissinen
7,679,565 B2 3/2010 Sorvala
7,692,543 B2 4/2010 Copeland
7,710,325 B2 5/2010 Cheng
7,724,204 B2 5/2010 Annamaa
7,760,146 B2 7/2010 Ollikainen
7,764,245 B2 7/2010 Loyet
7,786,938 B2 8/2010 Sorvala
7,800,544 B2 9/2010 Thornell-Pers
7,830,327 B2 11/2010 He
7,843,397 B2 11/2010 Boyle
7,889,139 B2 2/2011 Hobson et al.
7,889,143 B2 2/2011 Milosavljevic
7,901,617 B2 3/2011 Taylor
7,903,035 B2 3/2011 Mikkola et al.
7,916,086 B2 3/2011 Koskiniemi et al.
7,963,347 B2 6/2011 Pabon
7,973,720 B2 7/2011 Sorvala
8,049,670 B2 11/2011 Jung et al.
8,054,232 B2 11/2011 Chiang et al.
8,098,202 B2 1/2012 Annamaa et al.
8,179,322 B2 5/2012 Nissinen
8,193,998 B2 6/2012 Puente et al.
8,378,892 B2 2/2013 Sorvala
8,466,756 B2 6/2013 Milosavljevic et al.
8,473,017 B2 6/2013 Milosavljevic et al.
8,564,485 B2 10/2013 Milosavljevic et al.
8,629,813 B2 1/2014 Milosavljevic
2001/0050636 A1 12/2001 Weinberger
2002/0183013 A1 12/2002 Auckland et al.
2002/0196192 A1 12/2002 Nagumo et al.
2003/0146873 A1 8/2003 Blancho
2004/0090378 A1 5/2004 Dai et al.
2004/0137950 A1 7/2004 Bolin et al.
2004/0145525 A1 7/2004 Annabi et al.
2004/0147297 A1* 7/2004 Mikkola et al. ..... 455/575.7
2004/0171403 A1 9/2004 Mikkola
2005/0057401 A1 3/2005 Yuanzhu
2005/0153756 A1* 7/2005 Sato et al. ..... 455/575.7
2005/0159131 A1 7/2005 Shibagaki et al.
2005/0176481 A1 8/2005 Jeong
2006/0071857 A1 4/2006 Pelzer
2006/0176225 A1* 8/2006 Annamaa et al. ..... 343/702
2006/0192723 A1 8/2006 Harada
2007/0042615 A1 2/2007 Liao
2007/0082789 A1 4/2007 Nissila
2007/0152881 A1 7/2007 Chan
2007/0188388 A1 8/2007 Feng
2007/0268191 A1* 11/2007 Ishizuka et al. ..... 343/702
2008/0055164 A1 3/2008 Zhang et al.
2008/0059106 A1 3/2008 Wight
2008/0088511 A1 4/2008 Sorvala
2008/0266199 A1 10/2008 Milosavljevic
2009/0009415 A1 1/2009 Tanska
2009/0135066 A1 5/2009 Raappana et al.
2009/0153412 A1 6/2009 Chiang et al.
2009/0174604 A1 7/2009 Keskitalo
2009/0196160 A1 8/2009 Crombach
2009/0197654 A1 8/2009 Teshima
2009/0231213 A1 9/2009 Ishimiya
2010/0220016 A1 9/2010 Nissinen
2010/0244978 A1 9/2010 Milosavljevic
2010/0309092 A1 12/2010 Lambacka
2011/0133994 A1 6/2011 Korva
2012/0119955 A1 5/2012 Milosavljevic et al.

(56) References Cited

U.S. PATENT DOCUMENTS

FOREIGN PATENT DOCUMENTS

| | | | |
|---|---|---|---|
| DE | 10150149 | | 4/2003 |
| EP | 0 208 424 | | 1/1987 |
| EP | 0 376 643 | | 4/1990 |
| EP | 0 751 043 | | 4/1997 |
| EP | 0 807 988 | | 11/1997 |
| EP | 0 831 547 | | 3/1998 |
| EP | 0 851 530 | | 7/1998 |
| EP | 1 294 048 | | 1/1999 |
| EP | 1 014 487 | | 6/2000 |
| EP | 1020947 | A2 | 7/2000 |
| EP | 1 024 553 | | 8/2000 |
| EP | 1 067 627 | | 1/2001 |
| EP | 0 923 158 | | 9/2002 |
| EP | 1 329 980 | | 7/2003 |
| EP | 1 361 623 | | 11/2003 |
| EP | 1 406 345 | | 4/2004 |
| EP | 1439601 | A1 | 7/2004 |
| EP | 1439603 | A1 | 7/2004 |
| EP | 1 453 137 | | 9/2004 |
| EP | 1 220 456 | | 10/2004 |
| EP | 1 467 456 | | 10/2004 |
| EP | 1 753 079 | | 2/2007 |
| FI | 115342 | B | 5/2003 |
| FI | 20020829 | | 11/2003 |
| FI | 118782 | | 3/2008 |
| FI | 119404 | B | 5/2008 |
| FR | 2553584 | | 10/1983 |
| FR | 2724274 | | 3/1996 |
| FR | 2873247 | | 1/2006 |
| GB | 2266997 | | 11/1993 |
| GB | 2360422 | | 9/2001 |
| GB | 2389246 | | 12/2003 |
| JP | 59-202831 | | 11/1984 |
| JP | 60-206304 | | 10/1985 |
| JP | 61-245704 | | 11/1986 |
| JP | 06-152463 | | 5/1994 |
| JP | 07-131234 | | 5/1995 |
| JP | 07-221536 | | 8/1995 |
| JP | 07-249923 | | 9/1995 |
| JP | 07-307612 | | 11/1995 |
| JP | 08-216571 | | 8/1996 |
| JP | 09-083242 | | 3/1997 |
| JP | 09-260934 | | 10/1997 |
| JP | 09-307344 | | 11/1997 |
| JP | 10-028013 | | 1/1998 |
| JP | 10-107671 | | 4/1998 |
| JP | 10-173423 | | 6/1998 |
| JP | 10-209733 | | 8/1998 |
| JP | 10-224142 | | 8/1998 |
| JP | 10-322124 | | 12/1998 |
| JP | 10-327011 | | 12/1998 |
| JP | 11-004113 | | 1/1999 |
| JP | 11-004117 | | 1/1999 |
| JP | 11-068456 | | 3/1999 |
| JP | 11-127010 | | 5/1999 |
| JP | 11-127014 | | 5/1999 |
| JP | 11-136025 | | 5/1999 |
| JP | 11-355033 | | 12/1999 |
| JP | 2000-278028 | | 10/2000 |
| JP | 2001-053543 | | 2/2001 |
| JP | 2001-267833 | | 9/2001 |
| JP | 2001-217631 | | 10/2001 |
| JP | 2001-326513 | | 11/2001 |
| JP | 2002-319811 | | 10/2002 |
| JP | 2002-329541 | | 11/2002 |
| JP | 2002-335117 | | 11/2002 |
| JP | 2003-060417 | | 2/2003 |
| JP | 2003-124730 | | 4/2003 |
| JP | 2003-179426 | | 6/2003 |
| JP | 2004-112028 | | 4/2004 |
| JP | 2004-363859 | | 12/2004 |
| JP | 2005-005985 | | 1/2005 |
| JP | 2005-252661 | | 9/2005 |
| KR | 20010080521 | | 10/2001 |
| KR | 20020096016 | | 12/2002 |
| SE | 511900 | | 12/1999 |
| WO | WO 92/00635 | | 1/1992 |
| WO | WO 96/27219 | | 9/1996 |
| WO | WO 98/01919 | | 1/1998 |
| WO | WO 99/30479 | | 6/1999 |
| WO | WO 01/20718 | | 3/2001 |
| WO | WO 01/29927 | | 4/2001 |
| WO | WO 01/33665 | | 5/2001 |
| WO | WO 01/61781 | | 8/2001 |
| WO | 0219464 | A2 | 3/2002 |
| WO | WO 2004/017462 | | 2/2004 |
| WO | WO 2004/057697 | | 7/2004 |
| WO | WO 2004/100313 | | 11/2004 |
| WO | WO 2004/112189 | | 12/2004 |
| WO | 2005034286 | A1 | 4/2005 |
| WO | WO 2005/062416 | | 7/2005 |
| WO | WO 2007/012697 | | 2/2007 |
| WO | 2008059106 | A1 | 5/2008 |
| WO | 2010122220 | A1 | 10/2010 |
| WO | WO 2010/122220 | | 10/2010 |

OTHER PUBLICATIONS

"Dual Band Antenna for Hand Held Portable Telephones", Liu et al., Electronics Letters, vol. 32, No. 7, 1996, pp. 609-610.

"Improved Bandwidth of Microstrip Antennas using Parasitic Elements," IEE Proc. vol. 127, Pt. H. No. 4, Aug. 1980.

"A 13.56MHz RFID Device and Software for Mobile Systems", by H. Ryoson, et al., Micro Systems Network Co., 2004 IEEE, pp. 241-244.

"A Novel Approach of a Planar Multi-Band Hybrid Series Feed Network for Use in Antenna Systems Operating at Millimeter Wave Frequencies," by M.W. Elsallal and B.L. Hauck, Rockwell Collins, Inc., 2003 pp. 15-24, waelsall@rockwellcollins.com and blhauck@rockwellcollins.com.

Abedin, M. F. and M. Ali, "Modifying the ground plane and its erect on planar inverted-F antennas (PIFAs) for mobile handsets," *IEEE Antennas and Wireless Propagation Letters*, vol. 2, 226-229, 2003.

C. R. Rowell and R. D. Murch, "A compact PIFA suitable for dual frequency 900/1800-MHz operation," *IEEE Trans. Antennas Propag.*, vol. 46, No. 4, pp. 596-598, Apr. 1998.

Cheng-Nan Hu, Willey Chen, and Book Tai, "A Compact Multi-Band Antenna Design for Mobile Handsets", *APMC 2005 Proceedings*.

Endo, T., Y. Sunahara, S. Satoh and T. Katagi, "Resonant Frequency and Radiation Efficiency of Meander Line Antennas," Electronics and Commu-nications in Japan, Part 2, vol. 83, No. 1, 52-58, 2000.

European Office Action, May 30, 2005 issued during prosecution of EP 04 396 001.2-1248.

Examination Report dated May 3, 2006 issued by the EPO for European Patent Application No. 04 396 079.8.

F.R. Hsiao, et al. "A dual-band planar inverted-F patch antenna with a branch-line slit," *Microwave Opt. Technol. Lett.*, vol. 32, Feb. 20, 2002.

Griffin, Donald W. et al., "Electromagnetic Design Aspects of Packages for Monolithic Microwave Integrated Circuit-Based Arrays with Integrated Antenna Elements", IEEE Transactions on Antennas and Propagation, vol. 43, No. 9, pp. 927-931, Sep. 1995.

Guo, Y. X. and H. S. Tan, "New compact six-band internal antenna," *IEEE Antennas and Wireless Propagation Letters*, vol. 3, 295-297, 2004.

Guo, Y. X. and Y.W. Chia and Z. N. Chen, "Miniature built-in quadband antennas for mobile handsets", *IEEE Antennas Wireless Propag. Lett.*, vol. 2, pp. 30-32, 2004.

Hoon Park, et al. "Design of an Internal antenna with wide and multiband characteristics for a mobile handset", *IEEE Microw. & Opt. Tech. Lett.*, vol. 48, No. 5, May 2006.

Hoon Park, et al. "Design of Planar Inverted-F Antenna With Very Wide Impedance Bandwidth", *IEEE Microw. & Wireless Comp., Lett.*, vol. 16, No. 3, pp. 113-115—, Mar. 2006.

Hossa, R., A. Byndas, and M. E. Bialkowski, "Improvement of compact terminal antenna performance by incorporating open-end slots in ground plane," *IEEE Microwave and Wireless Components Letters*, vol. 14, 283-285, 2004.

(56) References Cited

OTHER PUBLICATIONS

I. Ang, Y. X. Guo, and Y. W. Chia, "Compact internal quad-band antenna for mobile phones" *Micro. Opt. Technol. Lett.*, vol. 38, No. 3 pp. 217-223 Aug. 2003.
International Preliminary Report on Patentability for International Application No. PCT/FI2004/000554, date of issuance of report May 1, 2006.
Jing, X., et al.; "Compact Planar Monopole Antenna for Multi-Band Mobile Phones"; Microwave Conference Proceedings, 4.-7.12.2005. APMC 2005, Asia-Pacific Conference Proceedings, vol. 4.
Kim, B. C., J. H. Yun, and H. D. Choi, "Small wideband PIFA for mobile phones at 1800 MHz," *IEEE International Conference on Vehicular Technology*, 27{29, Daejeon, South Korea, May 2004.
Kim, Kihong et al., "Integrated Dipole Antennas on Silicon Substrates for Intra-Chip Communication", IEEE, pp. 1582-1585, 1999.
Kivekas., O., J. Ollikainen, T. Lehtiniemi, and P. Vainikainen, "Bandwidth, SAR, and eciency of internal mobile phone antennas," *IEEE Transactions on Electromagnetic Compatibility*, vol. 46, 71{86, 2004.
K-L Wong, *Planar Antennas for Wireless Communications*, Hoboken, NJ: Willey, 2003, ch. 2.
Lindberg., P. and E. Ojefors, "A bandwidth enhancement technique for mobile handset antennas using wavetraps," *IEEE Transactions on Antennas and Propagation*, vol. 54, 2226{2232, 2006.
Marta Martinez-Vazquez, et al., "Integrated Planar Multiband Antennas for Personal Communication Handsets", *IEEE Trasactions on Antennas and propagation*, vol. 54, No. 2, Feb. 2006.
P. Ciais, et al., "Compact Internal Multiband Antennas for Mobile and WLAN Standards", *Electronic Letters*, vol. 40, No. 15, pp. 920-921, Jul. 2004.
P. Ciais, R. Staraj, G. Kossiavas, and C. Luxey, "Design of an internal quadband antenna for mobile phones", *IEEE Microwave Wireless Comp. Lett.*, vol. 14, No. 4, pp. 148-150, Apr. 2004.
P. Salonen, et al. "New slot configurations for dual-band planar inverted-F antenna," *Microwave Opt. Technol.*, vol. 28, pp. 293-298, 2001.
Papapolymerou, Ioannis et al., "Micromachined Patch Antennas", IEEE Transactions on Antennas and Propagation, vol. 46, No. 2, pp. 275-283, Feb. 1998.
Product of the Month, RFDesign, "GSM/GPRS Quad Band Power Amp Includes Antenna Switch," 1 page, reprinted Nov. 2004 issue of RF Design (www.rfdesign.com), Copyright 2004, Freescale Semiconductor, RFD-24-EK.
S. Tarvas, et al. "An internal dual-band mobile phone antenna," in 2000 *IEEE Antennas Propagat. Soc. Int. Symp. Dig.*, pp. 266-269, Salt Lake City, UT, USA.
Wang, F., Z. Du, Q. Wang, and K. Gong, "Enhanced-bandwidth PIFA with T-shaped ground plane," *Electronics Letters*, vol. 40, 1504-1505, 2004.
Wang, H.; "Dual-Resonance Monopole Antenna with Tuning Stubs"; IEEE Proceedings, Microwaves, Antennas & Propagation, vol. 153, No. 4, Aug. 2006; pp. 395-399.
Wong, K., et al.; "A Low-Profile Planar Monopole Antenna for Multiband Operation of Mobile Handsets"; IEEE Transactions on Antennas and Propagation, Jan. 2003, vol. 51, No. 1.
X.-D. Cai and J.-Y. Li, Analysis of asymmetric TEM cell and its optimum design of electric field distribution, IEE Proc 136 (1989), 191-194.
X.-Q. Yang and K.-M. Huang, Study on the key problems of interaction between microwave and chemical reaction, Chin Jof Radio Sci 21 (2006), 802-809.
Chiu, C.-W., et al., "A Meandered Loop Antenna for LTE/WWAN Operations in a Smartphone," Progress in Electromagnetics Research C, vol. 16, pp. 147-160, 2010.
Lin, Sheng-Yu; Liu, Hsien-Wen; Weng, Chung-Hsun; and Yang, Chang-Fa, "A miniature Coupled loop Antenna to be Embedded in a Mobile Phone for Penta-band Applications," Progress in Electromagnetics Research Symposium Proceedings, Xi'an, China, Mar. 22-26, 2010, pp. 721-724.
Zhang, Y.Q., et al. "Band-Notched UWB Crossed Semi-Ring Monopole Antenna," Progress in Electronics Research C, vol. 19, 107-118, 2011, pp. 107-118.
Joshi, Ravi K., et al., "Broadband Concentric Rings Fractal Slot Antenna", XXVIIIth General Assembly of International Union of Radio Science (URSI). (Oct. 23-29, 2005), 4 Pgs.
Singh, Rajender, "Broadband Planar Monopole Antennas," M. Tech credit seminar report, Electronic Systems group, EE Dept, IIT Bombay, Nov. 2003, pp. 1-24.
Gobien, Andrew, T. "Investigation of Low Profile Antenna Designs for Use in Hand-Held Radios," Ch.3, *The Inverted-L Antenna and Variations*; Aug. 1997, pp. 42-76.
See, C.H., et al., "Design of Planar Metal-Plate Monopole Antenna for Third Generation Mobile Handsets," Telecommunications Research Centre, Bradford University, 2005, pp. 27-30.
Chen, Jin-Sen, et al., "CPW-fed Ring Slot Antenna with Small Ground Plane," Department of Electronic Engineering, Cheng Shiu University.
"LTE—an introduction," Ericsson White Paper, Jun. 2009, pp. 1-16.
"Spectrum Analysis for Future LTE Deployments," Motorola White Paper, 2007, pp. 1-8.
Chi, Yun-Wen, et al. "Quarter-Wavelength Printed Loop Antenna With an Internal Printed Matching Circuit for GSM/DCS/PCS/UMTS Operation in the Mobile Phone," IEEE Transactions on Antennas and Propagation, vol. 57, No. 9m Sep. 2009, pp. 2541-2547.
Wong, Kin-Lu, et al. "Planar Antennas for WLAN Applications," Dept. of Electrical Engineering, National Sun Yat-Sen University, 2002 09 Ansoft Workshop, pp. 1-45.
"λ/4 printed monopole antenna for 2.45GHz," Nordic Semiconductor, White Paper, 2005, pp. 1-6.
White, Carson, R., "Single- and Dual-Polarized Slot and Patch Antennas with Wide Tuning Ranges," The University of Michigan, 2008.
Extended European Search Report dated Jan. 30, 2013, issued by the EPO for EP Patent Application No. 12177740.3.

* cited by examiner

ANTENNA WITH COVER RADIATOR AND METHODS

PRIORITY AND RELATED APPLICATIONS

This application is a National Stage Application of, and claims priority to, under 35 U.S.C. §371, International Application No. PCT/FI2011/050102, filed 7 Feb. 2011, which claims the benefit of priority to Finnish Patent Application Serial No. 20105158 filed 18 Feb. 2010, the priority benefit of which is also herein claimed, each of the foregoing being incorporated herein by reference in its entirety.

COPYRIGHT

A portion of the disclosure of this patent document contains material that is subject to copyright protection. The copyright owner has no objection to the facsimile reproduction by anyone of the patent document or the patent disclosure, as it appears in the Patent and Trademark Office patent files or records, but otherwise reserves all copyright rights whatsoever.

BACKGROUND OF THE INVENTION

1. Field of Invention

The invention relates generally to an antenna of a radio device, such as small-sized mobile wireless terminals, and particularly in one exemplary aspect to monopole antenna and related structures.

2. Description of Related Technology

In small-sized radio devices, such as mobile phones, the pursuit of space saving is a significant factor when designing a device. Regarding the antenna, using a dielectric substrate for the radiator, using a monopole radiator instead of PIFA (Planar Inverted-F Antenna), and the above-mentioned implementation of the radiator in the outer cover of the radio device are commonly used solutions which save space.

Making the radiator as a part of the device's outer cover is known. An example of such an arrangement is the solution for the antenna of a radio device shown in FIG. 1, known from the publication EP 1 439 603. Therein, a radio device can be seen from behind and its cross section at the antenna structure. The upper part 130 of the rear part of the device's outer cover is comprised of conductive material and functions as the radiator of the antenna. The radiator 130 joins the dielectric rest part 150 of the outer cover without discontinuity.

In the cross section shown in FIG. 1 there is seen the radiator 130, and below it the circuit board PCB of the device, on the upper surface of which board the ground plane GND of the antenna is located. Between the radiator and ground plane there is a conductive feed element 120 which is separated galvanically from the radiator by a distinct thin dielectric layer DIE. The radiator has no galvanic coupling to any conductive part of the radio device. Instead, the feed element 120 is coupled galvanically to the antenna port of the radio device by the feed conductor 116 and to the ground plane by the short-circuit conductor 115. An example of the shape of the feed element 120 is visible in the drawing of the radio device. It is a conductive strip comprising, as viewed from its short-circuit point SP, two arms with different lengths to implement two operating bands for the antenna. The longer arm of the feed element, the radiator 130, and the ground plane GND constitute a resonator, the natural frequency of which is in the lower operating band, and the shorter arm of the feed element, the radiator and the ground plane constitute a resonator, the natural frequency of which is in the higher operating band.

The use of the separate feed element is favourable, because in that case the placement of the antenna's operating bands and the matching of the antenna can be arranged without interfering with the shape of the radiator. However, a flaw of the solution in FIG. 1 is that good band characteristics and adequate efficiency require a remarkably long distance between the radiator and the ground plane GND. This again means that the need for antenna space is also in this case greater than desirable, thereby making the overall device size larger.

An object of the invention is to implement an antenna provided with a cover radiator in a new and advantageous way.

In one exemplary embodiment of the invention, radiator of an antenna is trough-like so that the head surface, front and rear surfaces and both side surfaces of the dielectric cover of a device are coated by it at an end of the radio device. On the side of the side surfaces there are slots in the radiator starting from its edge for increasing the electric size. The radiator is fed electromagnetically by a separate element which is shaped so that the antenna has at least two operating bands. The ground plane of the antenna is apart from the radiator, thus not extending inside the 'trough'.

An advantage of the invention is that the radiator of the exemplary antenna is short in the longitudinal direction of the radio device, and the space required by the antenna in the radio device is thus relatively small. This is due to the trough-like shape of the radiator and the slots on its sides. Thanks to the slots the radiator, which resonates at a certain frequency, becomes smaller. Also the monopole structure, or the location of the ground plane apart from the radiator, results in a smaller size of the radiator. Another advantage of the invention is that several resonances, which can be tuned separately, are provided for the antenna.

In another aspect of the invention, an antenna for use in a radio device is disclosed. In one embodiment, the antenna includes: a feed element having feed and short circuit points associated therewith, at least the short circuit point being in electrical communication with a ground plane of the radio device; and a device end cover, the end cover comprising a dielectric and having the feed element disposed on an interior surface thereof, and at least one conductive coating on an outer surface thereof, the at least one conductive coating forming at least part of a multiband radiator.

In another embodiment, the radio device has a head surface and first and second side surfaces, and the antenna comprises: a radiator having an antenna cover associated therewith, a feed element comprising an electromagnetic coupling to the radiator; and a ground plane in electrical communication with the radiator. In one variant, the antenna has at least a lower operating band and a higher operating band; the radiator is disposed substantially at an end of the radio device, and comprises a conductive coating of a dielectric cover of the radio device, the dielectric cover comprising a trough-like shape so that its bottom corresponds to the head surface of the radio device; the antenna cover is a part of the dielectric cover, and the radiator comprises a slot proximate at least one of the side surfaces and starting from an edge of the radiator and to decrease its physical size at the frequencies of the lower operating band of the antenna.

In a further aspect of the invention, a mobile wireless device is disclosed. In one embodiment, the device includes: a radio transmitter and receiver; a first device housing element; a circuit board disposed substantially with the first device cover, the circuit board comprising a ground plane; and a dielectric device end housing element comprising: a feed element having a short circuit point in communication with the ground plane, and a feed point coupled to the radio transmitter and receiver; and a slotted radiator formed on at least part of an exterior of the end housing element. The feed element, short circuit point, ground plane, and slotted radiator cooperate to provide the wireless device with multiband wireless capability.

In another aspect of the invention, a method of operating a wireless antenna is disclosed. In one embodiment, the antenna comprise a feed element with feed point, a short circuit point, a dielectric element, and a radiating element, and the method includes: feeding a signal to the feed element via the feed point; short circuiting the feed element to a ground plane via the short circuit point; and electromagnetically coupling at least portions of the feed element to the radiating element via the dielectric element, the coupling causing the radiator to radiate at least portions of the signal in at least one of an upper band and a lower band in which the antenna is capable of operating.

Figure 2:
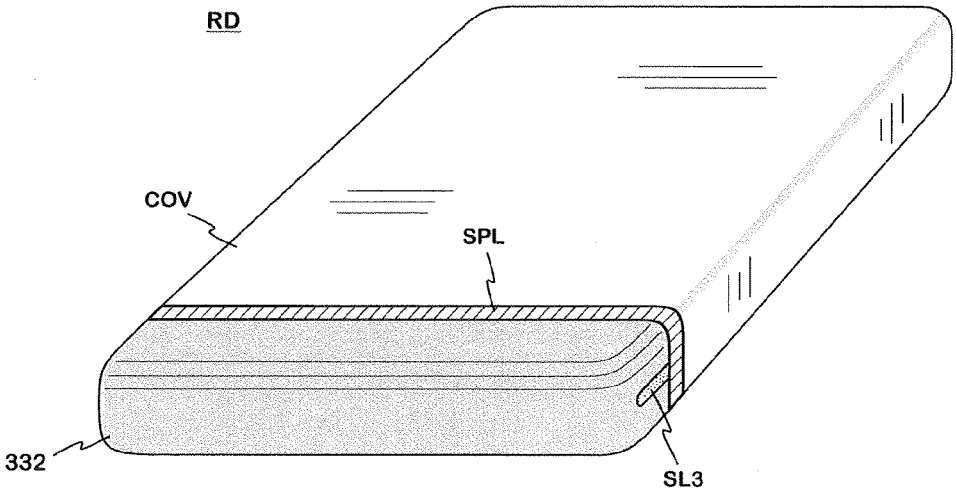
Figure 3:
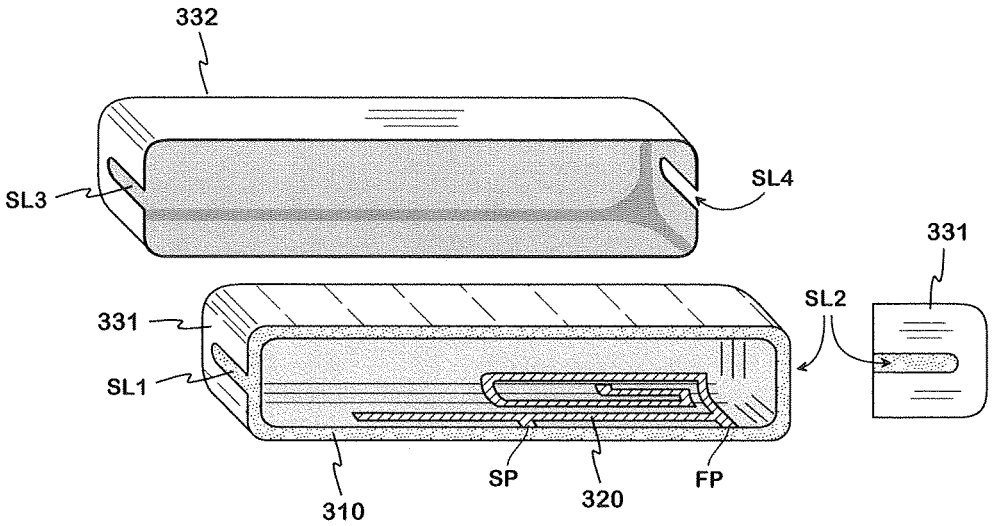
Figure 4:
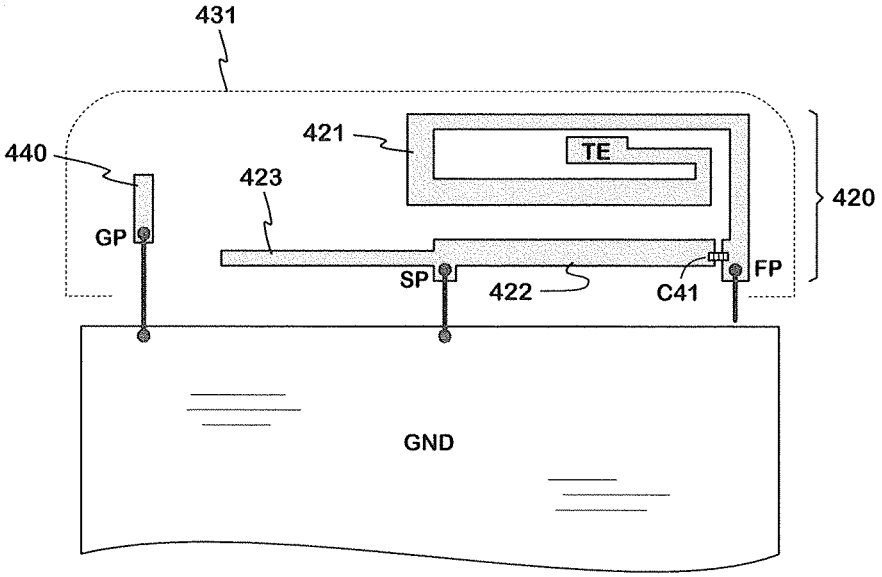
Figure 5:
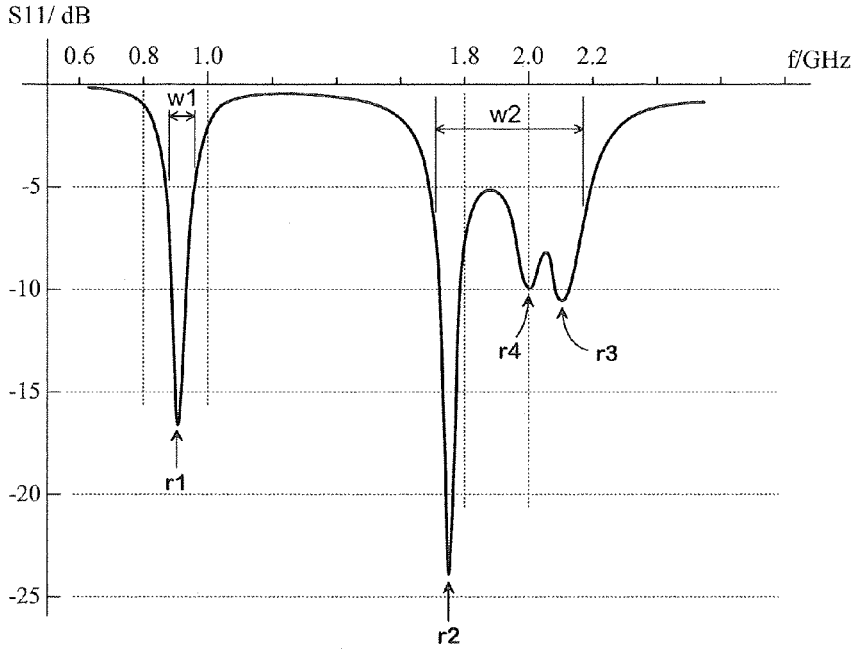
Figure 6:
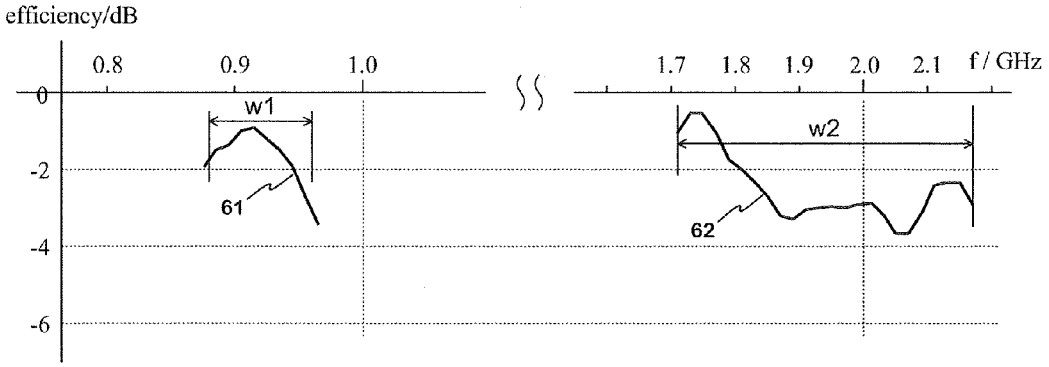

These and other features, objectives, and advantages of the invention will become more apparent from the detailed description set forth below when taken in conjunction with the drawings, wherein:

FIG. 1 presents an example of the antenna according to the prior art, in which the radiator is a part of the cover structure, FIG. 2 presents an example of the radio device provided with an antenna according to the invention, FIG. 3 presents an example of the antenna structure in the radio device according to FIG. 2, FIG. 4 presents an example of the feed element of an antenna according to the invention, FIG. 5 presents an example of the band characteristics of the antenna according to the invention and FIG. 6 presents an example of the efficiency of the antenna according to the invention.

FIG. 1 was already described in connection with the description of prior art.

FIG. 2 shows an example of the radio device provided with an antenna according to one embodiment of the invention. The radio device RD is elongated and relatively flat so that it has two ends, head surfaces corresponding to these ends, front and rear surfaces, and first and second side surfaces. The antenna radiator is located at one end of the device which can be the end on the side of the device's speaker or the opposite end. In the figure is shown the outer cover of the device which comprises the main part COV of the cover and the antenna cover 332. In this example, the antenna cover is of conductive material, for which reason it functions as a part of the radiating structure. The radiator proper is disposed underneath it. Also, the main part COV of the cover is in this example of conductive material, for which reason there is a relatively narrow non-conductive part SPL of the outer cover between it and the antenna cover 332.

The antenna cover of the embodiment of FIG. 2 is trough-like by shape, opening naturally towards the middle part of the radio device. A slot, such as the first slot SL3, is formed on the side of the both side surfaces of the antenna cover, starting from its edge. These slots are discussed in greater detail below with respect to the description of FIG. 3.

FIG. 3 shows an example of the structure according to the invention. The antenna of the radio device presented in FIG. 2 is used as the example. The structure comprises dielectric cover 310, feed element 320, radiator 331 and the above-mentioned antenna cover 332. For the sake of clarity, the antenna cover has been drawn as separate in the figure; in the assembled device it is disposed over the other parts of the antenna structure.

The dielectric cover 310 forms the frame of the end of the radio device and, at the same time, the antenna frame. It is trough-like by shape so that it has a bottom, opposite short sides and opposite long sides. The bottom corresponds to the head surface of the whole device, the short sides correspond to the side surfaces of the whole device at the device's end in question, and the long sides correspond to the front and rear surfaces of the whole device at the device's end. On the outer surface of the dielectric cover 310 there is disposed the radiator 331. This has, in the illustrated embodiment, been implemented by metallizing the outer surface e.g. with the LDS method (Laser Directed Structuring). Therefore, the radiator is trough-like following by shape the head surface, the front and rear surfaces and the side surfaces of the radio device. The areas of the outer surface of the dielectric cover starting from the edges of its short sides are left without metallizing so that on the side of the side surfaces of the radio device, there are slots directed from the edge of the radiator towards its bottom. On the side of the first side surface there is the first slot SL1, and on the side of the second side surface there is the second slot SL2. These slots increase the electric size of the radiator. As a result, the resonance, which corresponds to the lowest operating band of the antenna, can advantageously be realized by means of a physically smaller radiator compared to a radiator without said slots.

The width of the radio device determines the length of the radiator, in which case the decrease in size means the shortening of the radiator in the longitudinal direction of the device, or in the depth direction of the radiator.

On the inner surface of the dielectric cover 310 there is disposed the feed element 320 of the radiator. In the illustrated example it extends in the depth direction from the open edge of the dielectric cover to the bottom surface of the cover. The feed element is connected to the transmitter and receiver of the radio device from its certain point FP, which is the feed point of the antenna. Only an electromagnetic coupling exists between the feed element and the radiator. The feed element is shaped so that it has several resonances together with the radiator and ground plane. The operating bands of the dual-band antenna are based on these resonances. An example of the foregoing is shown in FIGS. 4 and 5. The feed element is connected also to the ground plane of the antenna from its short-circuit point SP.

In the finished structure, the antenna cover 332 is tightly placed on the radiator. If the antenna cover is formed of conductive material, as in this example, slots are needed on the side surfaces of the device in order to prevent the short-circuit of the slots SL1, SL2 of the radiator. The third slot SL3 in the antenna cover is formed at above-mentioned first slot SL1, and the fourth slot SL4 is formed at the second slot SL2. If the radio device has a steel cover, also the antenna cover is formed of steel for the sake of appearance. As a conductor, steel is clearly poorer than the metal which is used as the radiator 331. For this reason, an antenna cover made of steel has little significance as a radiator, although it in principle functions as a part of the radiating structure. The antenna cover can also be made of a non-conductive material, in which case it may lack the slots SL3 and SL4 seen in FIG. 3.

FIG. 4 shows an example of the feed element of an antenna according to one embodiment of the invention, as if spread on a plane. Also, the ground plane GND of the antenna is visible in the figure, and is located beside the feed element (and thus also the radiator 431 as viewed in the direction of the normal of the ground plane). The ground plane is in this embodiment parallel with the front and rear surface of the radio device.

The feed element 420 includes the short-circuit point SP and the feed point FP of the whole antenna, and it includes in the illustrated embodiment three parts. The first part 421 comprises six successive portions which form a simple spiral pattern: the first portion of the first part starts from the feed point FP and is directed away from the ground plane, that is, towards the bottom of the radiator. The second portion is parallel with the edge of the ground plane, or perpendicular to the first portion. The third portion is directed back towards the ground plane, the fourth portion towards the first portion, the fifth portion towards the second portion and the sixth portion towards the third portion. In the tail end TE of the sixth portion, there is an extension towards the second portion for strengthening the electromagnetic coupling between the tail end and the second portion.

The second part 422 of the feed element 420 is a mainly straight conductor strip between the ground plane GND and the spiral formed by the first part 421. The second part starts from the feed point FP, and ends at the point from which the feed element is connected to the ground plane, or the short-circuit point SP. In the example of FIG. 4, there is included a capacitive element C41 between the feed point and the starting end of the second part. By means of the capacitance, the antenna matching in the lower operating band is improved so that this band is widened.

The third part 423 of the feed element of the illustrated embodiment is a continuation of the second part from the short-circuit point SP forward. It has the same direction as the second part, and is open at its outer end.

The exemplary feed element 420 has three significant resonances together with the radiator and ground plane. The lowest frequency resonance, or the first resonance, is based on the electric length of the structure constituted by the first 421 and second 422 part of the feed element and the capacitive element between these parts. The higher frequency resonance, or the second resonance, is based on the electric length of the conductor constituted by the second 422 and third 423 part. It can be tuned by changing the physical length of the third part. The highest frequency resonance, or the third resonance, is a harmonic resonance of the first resonance. It can be tuned by changing the electromagnetic coupling between the second and sixth portions of the first part 421 by shaping the tail end TE of the sixth portion.

Also, a tuning element 440 is seen in FIG. 4. It is in one embodiment comprised of a conductor strip on the inner surface of the dielectric cover, connected to the ground plane from its one end. The tuning element is used to affect the resonance which the radiator has alone (naturally with the co-operation of the ground plane), which resonance is then the fourth significant resonance of the antenna to be considered. The tuning element can be located, in respect of the feed element, for example, on the opposite side of the trough formed by the dielectric cover.

FIG. 5 shows an example of the band characteristics of an exemplar, antenna configured according to the invention. The antenna used as the basis of FIG. 5 is comparable to that presented in the previous figures; the capacitance of the matching capacitor C41 between the feed point and second part of the feed element is 4.7 pF. The curve shows the fluctuation of the reflection coefficient S11 of the antenna as the function of frequency. The lower the reflection coefficient, the better the antenna has been matched. The feed element is shaped so that the antenna has two operating bands, the lower and higher one. The lower operating band is based on the above-mentioned first resonance r1, the frequency of which is about 0.9 GHz. It is seen from the curve that the lower operating band covers the frequency range 880-960 MHz (w1 in the figure) used by the EGSM system (Extended GSM), when the value −5 dB of the reflection coefficient is considered to be the criterion of the boundary frequency of the band. The higher operating band is based on the above-mentioned second, third and fourth resonance. The frequency of the second resonance r2 is about 1.75 GHz, the frequency of the third resonance r3 is about 2.1 GHz and the frequency of the fourth resonance r4 is about 2.0 GHz. It is seen from the curve that the higher operating band well covers the frequency range 1710-2170 MHz (w2 in the figure) used by the systems GSM 1800, GSM 1900 and WCDMA in all. The fourth resonance is tuned between the second and third resonances on the frequency scale, by which means the reflection coefficient can be kept low in the entire large operating band. Without the fourth resonance, the antenna matching would be poor in the middle range of the band.

FIG. 6 shows an example of the efficiency of an antenna in free space according to one embodiment of the invention. Curve 61 shows the fluctuation of the efficiency in the lower operating band. In the range w1, the efficiency fluctuates between −1 dB and −3 dB, being about −1.6 dB on average. Curve 62 shows the fluctuation of the efficiency in the higher operating band. In the range w2, the efficiency fluctuates between −0.5 dB and −3.7 dB, being about −2.4 dB on average. The values of the efficiency are accordingly quite good.

An adjustable antenna according to the invention has been described above. In details, its structure can naturally differ from what is presented. For example, the shape of the feed element of the antenna can vary widely. The resonance frequencies of the antenna can be arranged also so that the number of the operating bands is more than two. The feed element can also be located on the surface of a separate thin and flexible dielectric plate which is fastened on the surface of the antenna frame. The antenna frame again can be, besides the same as the dielectric cover of the antenna, also a separate dielectric object to be placed inside the dielectric cover. The tuning element affecting the resonance frequency of the radiator can be located at different places in the antenna structure. The inventive idea can be applied in different ways within the scope of the invention as set forth in the various exemplary embodiments and disclosure provided herein.

The invention claimed is:

1. An antenna for use in a radio device, comprising:

a feed element having feed and short circuit points associated therewith, at least the short circuit point being in electrical communication with a ground plane of the radio device; and a device end cover, the end cover comprising a dielectric, two end surfaces, and having the feed element disposed on an interior surface thereof, and at least one conductive coating comprising a multiband radiator disposed on an outer surface thereof, the at least one conductive coating comprising at least one slot formed on each of the two end surfaces.

2. The antenna of claim 1, wherein the end cover is substantially tub-shaped and has an interior volume, and the ground plane is disposed so that it does not enter into the interior volume.

3. The antenna of claim 1, wherein the conductive coating comprises a laser-direct structured (LDS) coating.

4. The antenna of claim 1, further comprising a metallic cover element disposed substantially over the end cover, wherein the metallic cover element acts as part of the radiator.

5. The antenna of claim 1, wherein the end cover is substantially rectangular.

6. The antenna of claim 5, wherein the antenna comprises a multiband monopole antenna having an upper and a lower operating band.

7. The antenna of claim 6, wherein the slots are configured to increase the electric size of the radiator, and to decrease the physical size of the radiator at frequencies within the lower operating band.

8. The antenna of claim 5, wherein the end cover comprises an interior volume, and disposition of the radiator at the end cover of the radio device allows the ground plane to be disposed outside of the interior volume, thereby allowing the device to be thinner than if the feed element were disposed on a front or back cover of the radio device.

9. A mobile wireless device, comprising a radio transmitter and receiver;

a first device housing element;

a circuit board disposed substantially with the first device housing element, the circuit board comprising a ground plane; and a dielectric device end housing element comprising:

a feed element having a short circuit point in communication with the ground plane, and a feed point coupled to the radio transmitter and receiver; and a radiator formed on at least part of an exterior of the end housing element, the radiator comprising a trough-like shape with two opposing side surfaces, each opposing side surface comprises at least one slot formed therein and each slot starts from an edge of its respective side surface;

wherein the feed element, short circuit point, ground plane, and radiator cooperate to provide the wireless device with multiband wireless capability.

10. The mobile wireless device of claim 9, wherein no portion of the ground plane is disposed within the end housing element.

11. The mobile wireless device of claim 9, wherein the end housing element further comprises a substantially metal antenna cover, and the first device housing element is made from a similar metal as the antenna cover, the first device housing element and the end housing element separated by a dielectric material.

12. A method of operating a wireless antenna, the antenna comprising a feed element with a feed point, a short circuit point, a dielectric element, and a radiating element, the method comprising:

feeding a signal to the feed element via the feed point;

short circuiting the feed element to a ground plane via the short circuit point; and electromagnetically coupling at least portions of the feed element to the radiating element via the dielectric element, the coupling causing the radiating element to radiate at least portions of the signal in at least one of an upper band and a lower band in which the antenna is capable of operating;

wherein the antenna further comprises an at least partly metallic antenna cover disposed over at least a portion of the radiating element, the radiating element and the antenna cover comprising two opposing short sides and two opposing lone sides, each opposing short side having at least one slot formed therein directed from an edge thereof; and wherein the slots are used to (i) increase the electric size of the radiating element, and to (ii) decrease the physical size of the radiating element at one or more frequencies within the lower band.

13. The method of claim 12, comprising using the antenna cover as part of the radiating element.

14. An antenna for use in a radio device, the radio device having a head surface and first and second opposing side surfaces, the antenna comprising:

a radiator having an antenna cover associated therewith, a feed element comprising an electromagnetic coupling to the radiator; and a ground plane in electrical communication with the radiator;

wherein:

the antenna has at least a lower operating band and a higher operating band;

the radiator is disposed substantially at an end of the radio device, and comprises a conductive coating of a dielectric cover of the radio device, the dielectric cover comprising a trough-like shape so that a bottom of the dielectric cover corresponds to the head surface of the radio device;

the antenna cover is a part of the dielectric cover; and the radiator comprises a slot proximate each of the first and second opposing side surfaces and which start from an edge of the radiator in order to decrease a physical size of the antenna at the frequencies of the lower operating band of the antenna.

15. The antenna of claim 14, wherein the feed element comprises:

a feed point configured to be coupled with a transmitter and receiver of the radio device; and a short-circuit point in communication with the ground plane; and wherein the feed element has, together with the radiator and ground plane, at least one first resonance on which the antenna's lower operating band is based at least in part, and at least one second resonance on which the antenna's higher operating band is based at least in part.

16. The antenna of claim 15, wherein the feed element further comprises:

a first part which starts from the feed point and forms a substantially spiral pattern;

a second part which starts from the feed point and ends at the short-circuit point, the second part being between the first part and the ground plane; and a third part which starts from the short-circuit point and being open at its outer end, the at least one first resonance is further based on the electric length of a structure formed by the first part and the second part of the feed element, and the at least one second resonance is further based on the electric length of a conductor formed by the second part and the third part, and on a harmonic resonance of the at least one first resonance.

17. The antenna of claim 15, further comprising a capacitive element between the feed point and the starting end of the second part, the capacitive element configured to improve antenna matching in the lower operating band.

18. The antenna of claim 14, further comprising a tuning element in electrical communication with the ground plane from at least one end thereof and configured to shift a frequency of a resonance which the radiator has with the ground plane, to a desired value.

19. The antenna of claim 14, wherein the feed element is disposed on the inner surface of the dielectric cover.

20. The antenna of claim 14, wherein the antenna cover comprises a conductive material, at least a portion of the conductive material configured to form at least a part of the radiator.

21. The antenna of claim 14, wherein the antenna cover comprises a non-conductive material.

* * * * *